US008772615B2

(12) United States Patent
Adams

(10) Patent No.: US 8,772,615 B2
(45) Date of Patent: Jul. 8, 2014

(54) ADJUSTMENT DRIVE FOR ADJUSTING THE STRING TENSION OF A STRINGED INSTRUMENT

(75) Inventor: Christopher Adams, Hamburg (DE)

(73) Assignee: Goodbuy Corporation S.A., Vaduz (LI)

( * ) Notice: Subject to any disclaimer, the term of this patent is extended or adjusted under 35 U.S.C. 154(b) by 74 days.

(21) Appl. No.: 13/636,816

(22) PCT Filed: Mar. 24, 2011

(86) PCT No.: PCT/EP2011/054571
§ 371 (c)(1),
(2), (4) Date: Sep. 24, 2012

(87) PCT Pub. No.: WO2011/117368
PCT Pub. Date: Sep. 29, 2011

(65) Prior Publication Data

US 2013/0008298 A1 Jan. 10, 2013

(30) Foreign Application Priority Data

Mar. 24, 2010 (EP) ..... 10157642

(51) Int. Cl.
*G10D 3/14* (2006.01)

(52) U.S. Cl.
USPC ..... 84/304

(58) Field of Classification Search
USPC ..... 84/304
See application file for complete search history.

(56) References Cited

U.S. PATENT DOCUMENTS

| | | | | |
|---|---|---|---|---|
| 1,554,772 | A * | 9/1925 | Weymann | 84/304 |
| 1,802,937 | A * | 4/1931 | Bertram | 84/304 |
| 4,375,180 | A * | 3/1983 | Scholz | 84/454 |
| 4,426,907 | A * | 1/1984 | Scholz | 84/454 |
| 5,886,270 | A | 3/1999 | Wynn | |
| 7,659,467 | B2 * | 2/2010 | Adams | 84/306 |
| 7,692,085 | B2 * | 4/2010 | Adams | 84/454 |
| 7,858,865 | B2 * | 12/2010 | D'Arco | 84/454 |
| 7,935,876 | B1 * | 5/2011 | West | 84/304 |
| 8,110,733 | B2 * | 2/2012 | D'Arco | 84/454 |
| 2008/0006140 | A1 * | 1/2008 | Adams | 84/455 |
| 2013/0008298 | A1 * | 1/2013 | Adams | 84/304 |
| 2014/0033893 | A1 * | 2/2014 | Villaran-Valdivia | 84/304 |

FOREIGN PATENT DOCUMENTS

| | | |
|---|---|---|
| WO | 2005114647 | 12/2005 |
| WO | 2006097126 | 9/2006 |

* cited by examiner

*Primary Examiner* — Robert W Horn
(74) *Attorney, Agent, or Firm* — Sand & Sebolt

(57) ABSTRACT

A combined manual and motorized adjustment drive for adjusting the string tension of a stringed instrument having a tuning peg, a drive motor, a force-transmitting member for transmitting a drive force to the tuning peg and a manually operable adjustment element which couples with the force-transmitting member for manual adjustability of the rotary position of the tuning peg wherein said adjustment drive is improved in that in allows a compact design in addition to reliable self-retention and good adjustability of the manual drive. The force-transmitting member is an at least three-stage reduction gear having a first gear stage on which the drive motor acts with an output shaft and a last gear stage which acts on the tuning peg in order to rotate the latter, and the adjustment element acts on a gear stage of the reduction gear between the first and the last gear stages to introduce the force.

17 Claims, 1 Drawing Sheet

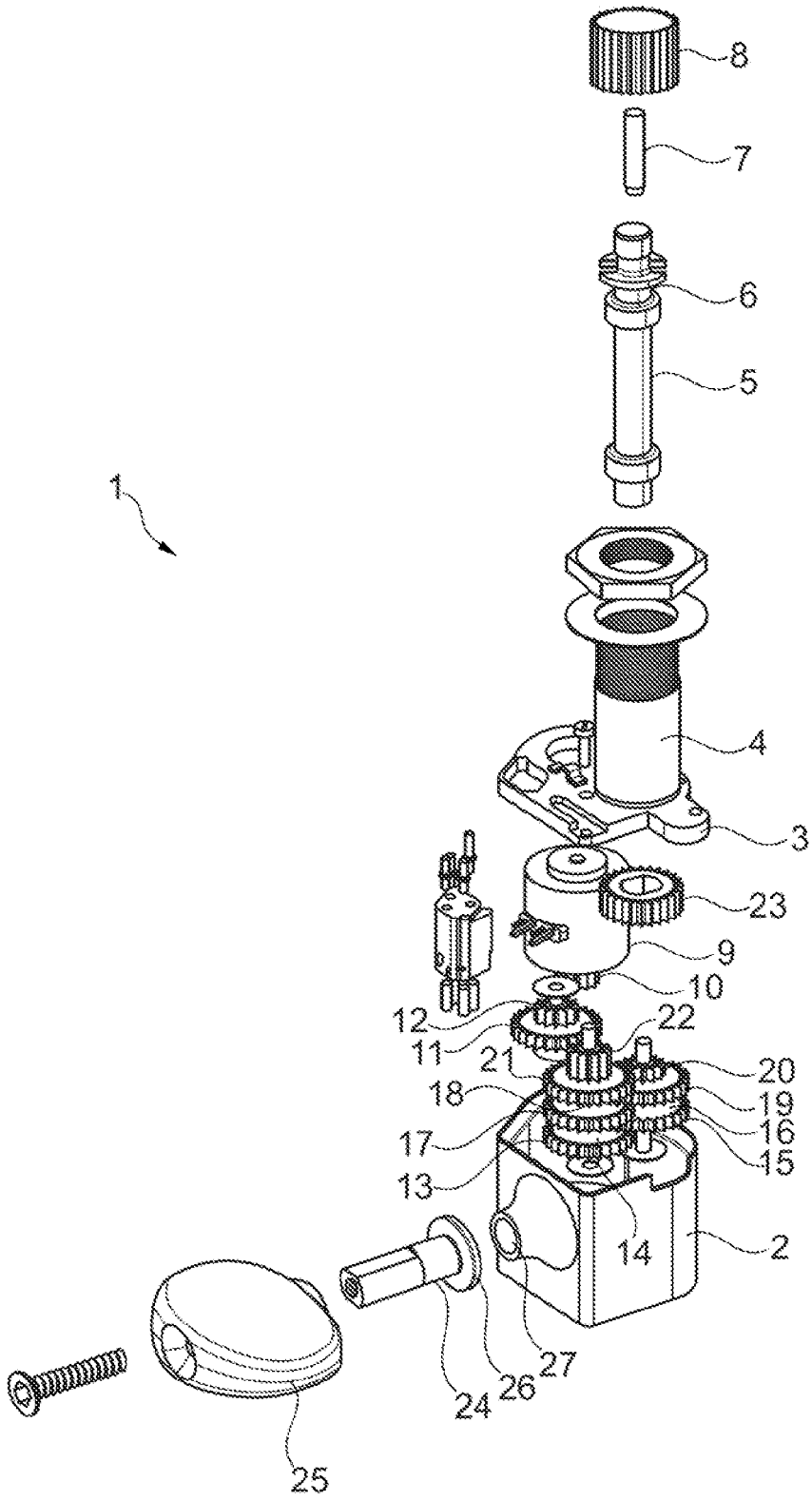
8
7
6
5
1
4
3
23
9
10
12
22
11
21
20
18
19
16
17
15
13
14
2
27
26
24
25

ADJUSTMENT DRIVE FOR ADJUSTING THE STRING TENSION OF A STRINGED INSTRUMENT

TECHNICAL FIELD

The present invention relates to a combined manual and motorized adjustment drive for adjusting the string tension of a stringed instrument, in particular a guitar, comprising a tuning peg for winding and unwinding a string running thereon; a drive motor, in particular an electric motor; a force-transmitting member for transmitting a drive force generated by the drive motor to the tuning peg for rotating the latter; and a manually operable adjustment element which couples with the force-transmitting member for manual adjustability of the rotary position of the tuning peg.

PRIOR ART

Adjustment drives of this kind are, in principle, known and they gain particular importance in connection with stringed instruments that are equipped with automatic tuning devices. In onboard tuning devices of this kind, the tuning of the musical instrument is fully automatic and performed under the control of a computing and comparison unit, wherein such a unit evaluates the signals and data that have been recorded by a detector unit and that correspond to the actual tuning, compares the same to the set tuning, and issues the corresponding correction and control commands to the drive motor of the adjustment device. A motorized adjustment is then made to the adjustment device via the drive motor until the set tuning of the string has been reached with the degree of precision desired.

However, since the option of adjusting and tuning the strings by hand is frequently still desirable in the case of such automatic tuning systems, the adjustment drives must also be formed as hybrids that, in addition to a drive motor, also feature a manually operated adjustment element, for example a wing screw or an attachment peg for a tuning device or something similar, by means of which the tuning peg on which the string being tuned runs can be turned and thus the string tension and its tuning modified.

An example of such an adjustment drive is disclosed in WO 2005/114647 A1. The spur gear transmission therein transmits the output from a motorized assembly to a gear that is disposed directly on the shaft of an impeller acting as a manual adjustment drive; and in turn, a worm gear disposed on the same shaft then transmits the force to a further gear that is connected to the tuning peg.

The arrangement shown therein has been selected because a self-locking action of the drive is achieved through the combination of the worm gear and the spur gear on the tuning peg; i.e., because of the tractive force exerted by the string on the tuning peg and the associated torque, the string cannot unwind from the tuning peg, since the rotational position of said peg is blocked by the gear friction. The torque that is exerted on the tuning peg due to the typically present string tension is, in other words, not powerful enough to overcome the inhibitory holding forces of the gear.

This precondition of self-locking action is essential for the motor-driven and manually driven variants, since in order to have the simultaneous option of a manual adjustment, the motor cannot be allowed to block that adjustment even when in the inoperative state. Otherwise the manual adjustment element could not be moved and a manual adjustment of the tuning peg would not be possible.

With regard to the self-locking action, the solution shown in WO 2005/114647 A1 already meets these requirements. However, the installation space required by the solution shown is still very large, which makes retrofitting existing instruments with closely arranged strings and tuning pegs, in particular, difficult, and the acceptance of such a solution would be low.

SUMMARY OF THE INVENTION

In this respect, an improved, combined manual and motorized adjustment drive is needed that allows for a compact design in addition to likewise reliable self-locking action and good adjustability of the manual drive.

The adjustment drive according to the invention is characterized by the fact that the force-transmitting member by which the force from the output shaft of the motor is transmitted to the tuning peg, is an at least three-stage reduction gear, wherein the first stage is the stage when the output shaft of the drive motor engages, and the last stage is the stage when the force is transmitted to the tuning peg for rotating the latter. Furthermore, the adjustment drive according to the invention is characterized by the fact that the adjustment element for manually adjusting the drive acts on a stage of the reduction gear between the first and the last stage in order to introduce the force.

On the one hand, the selection of a multi-stage, at least three-stage gear system makes it possible to design the individual gear elements in a comparatively delicate manner, despite the necessary transfer of high forces that are needed to tighten and hold the strings at the specific tension needed for the desired tuning. Additionally, the multi-level design makes it possible to fit the individual gear stages together in a very compact manner thus embodying a very small dimensioned gear, and therefore embodying an adjustment drive with overall especially small dimensions.

Due to the engagement of the adjustment element with a stage that falls between the first and the last stage of the reduction gear, the entire gear train can be designed to exhibit the needed self-locking action in all stages, whereas, however, the friction forces in the gear that must be overcome when operating the adjustment element are low both in the direction of the tuning peg and in the reverse direction of the unconnected, freely rotating drive motor allowing the adjustment element to be operated and moved by hand without substantial additional resistance.

It is thereby advantageous for the reduction gear to have at least four stages, and in particular, seven stages. More than three, in particular four and up to seven gear stages, allow a more flexible and smaller-dimensioned distribution and arrangement of the entire gear system in terms of the individual components, with the corresponding advantage of a compact installation space. A spur gear unit has been proven to be especially advantageous in achieving this objective.

In order to achieve the objective of self-locking of the entire gear unit while simultaneously retaining the option of manual adjustment, the reduction gear is advantageously designed such that the overall reduction of the reduction gear and the reduction ratios of the individual gear stages are selected and adjusted to the drive motor in such a way that a self-locking action is created by the overall reduction of the reduction gear while the adjustment element is moved by hand by manually turning the tuning peg. At the same time, there is an adjustment to the drive motor taking into account the maximum force that can be generated by the motor and the usual force applied to the last gear stage by a string held in tune, or that is needed and that must be applied to tighten and hold the string at the correct pitch, respectively.

With regard to the reduction ratio of the overall reduction, values between 3,000:1 and 4,000:1, in particular between 3,500:1 and 4,000:1, and especially preferably between 3,770:1 and 3,780:1, have proven expedient. An expedient reduction of the gear stage(s) that falls between the introduction of force by the adjustment element and the tuning peg advantageously falls in the range between 30:1 and 50:1, and in particular between 35:1 and 45:1.

With regard to the introduction of force by the adjustment element, introducing the force in the fourth gear stage in the case of a seven-stage reduction gear has proven expedient.

The use of a step motor as a drive motor has proven advantageous, especially for very high-precision tuning, but also for quickly reaching an initial tuning state that falls within a target window for precise tuning. Due to the very precisely pre-determinable angular positions, this motor can be brought directly to a target window without measuring the frequency of the string so that, subsequently, the frequency window and the adjustment travel are not so great and tuning can be adjusted more quickly.

As previously mentioned, one aspect of the invention includes a device for the automatic tuning of a string of a stringed instrument, which commonly features a means of detection for determining the current tuning of the string, a computing and comparison unit for comparing the current tuning with a set tuning value and for generating adjustment signals, and which contains an adjustment drive as described above the drive motor of which can change the string tension depending upon the adjustment signals.

Finally, an additional aspect of the invention is a stringed instrument, in particular a guitar, that, as previously mentioned, contains an adjustment drive or a device for automatic tuning as described above.

BRIEF DESCRIPTION OF THE DRAWINGS

Further advantages and characterizing features of the invention will become apparent from the following description of an embodiment with reference to the accompanying figures. Shown are in:

FIG. 1 an exploded view of an embodiment of an adjustment drive according to the invention.

MODE(S) OF IMPLEMENTING THE INVENTION

The only FIG. 1 shows an embodiment of an adjustment drive 1 according to the invention which can be operated manually and using a motorized drive. The adjustment drive, with its essential components, is disposed in a housing that is constituted of a lower part of the housing 2 and a housing cover 3, which can be placed on this lower part of the housing 2 essentially locking the same. A guide sleeve 4 is formed in one piece with the housing cover 3 inside which guide sleeve a tuning peg 5 is radially guided. The tuning peg 5 has a winding section 6 on which a free end of a string of the stringed instrument is wound up, in this case of a guitar, and in particular an electric guitar. The tuning peg 5 is rotated in a manner known in the art in order to wind or unwind the end of the string onto or from the winding section 6, respectively, in order to vary the string tension and thereby the tuning of that string.

The end of the string is attached to the tuning peg 5 using a combination of a clamping pin 7 and a clamping screw 8. The clamping pin 7 is inserted, coming from the direction of the front side, into the tuning peg 5, as shown in FIG. 1 above. The clamping screw 8 has an internal thread corresponding to the external thread that is disposed around the circumference of the front end of the tuning peg 5, as shown in FIG. 1 above, and that can engage therein such that the clamping screw 8 can be screwed thereon. There is a transversely drilled hole (not shown in greater detail herein) disposed in the winding section 6 through which the free end of the string can be inserted. The clamping pin acts on the end of the string in the transversely drilled hole and presses the string from above against an abutment (not shown in greater detail here) inside the tuning peg 5 clamping the string in place by means of the clamping force that is applied by the clamping screw 8 on the clamping pin 7.

The adjustment drive 1 is equipped with a drive motor 9 for the motorized adjustment of the rotary position of the tuning peg 5, wherein this drive motor is an electric motor; specifically, a step motor in the present embodiment. On the output shaft of the drive motor 9, a gear 10 having circumferential toothing is disposed. This gear meshes by the circumferential toothing thereof with a larger-diameter gear 11 constituting the first gear stage of a multi-stage reduction gear, and which is disposed on a first axis such that it can rotate freely. Firmly connected to this gear 11 is a smaller-diameter gear 12 that meshes with a larger-diameter gear 13 that is disposed as freely rotating on a second axis. The same constitutes a second gear stage of the reduction gear. Disposed above thereto and firmly connected to gear wheel 13 is a larger-diameter gear 14, which is disposed on the same second axis and meshes with a freely-rotating, larger-diameter gear 15 on a third axis constituting the third gear stage of the reduction gear. A gear wheel 16 is disposed above and firmly connected with the smaller-diameter gear wheel 15. A gear 16 having a smaller diameter, which is disposed there-above, is firmly connected to the gear 15. Gear 16 meshes with an additional, larger-diameter gear 17, which is arranged above gear 14 on the second axis and constitutes the fourth gear stage. An additional, smaller-diameter gear 18 is firmly connected to gear 17. Gear 18 meshes with a freely-rotating, larger-diameter gear 19 disposed on the third axis above gear 16 constituting the fifth gear stage. Firmly connected to gear 19 is an additional, smaller-diameter gear 20. This gear 20 meshes with the final, larger-diameter gear 21 on the second axis above the gear wheel 18 and rotates freely and independently of the latter around the second axis. This gear constitutes the sixth gear stage. Firmly connected to this gear 21 is a gear 22 that is disposed above gear wheel 21 on the same second axis and which, in a seventh and last gear stage, transmits the force to a gear 23 that is firmly connected to the tuning peg and powers the tuning peg to rotate.

In this way, the drive force generated by the drive motor 9 is transmitted to the tuning peg 5 via a multi-stage (a total of seven stages) reduction gear, wherein this reduction gear is a spur gear unit. The total reduction ratio is at approximately 3775:1 and selected such that it establishes a self-locking action for the range of force exerted by the string running on the winding section 6 of the tuning peg 5 or the torque associated with the same, respectively. This is necessary since the drive motor 9 is a free-wheeling drive motor when it is in a currentless state; and this is, moreover, necessary in order for it to provide the additional powering option of the adjustment drive 1 using a manual actuation.

Gear 10, 11, 12, 13, 14 and 23, which are subjected to special stresses and forces, are preferably constructed of brass or bronze. On the one hand, these materials are sufficiently stable, and, on the other, they allow for a fitted run-in of these gears and "self-lubrication". The additional gear 15, 16, 17,

18, 19, 20, 21 and 22 are preferably manufactured of steel using so-called metal injection molding (MIM). This method allows for the relatively low-cost manufacture of durable and dimensionally precise gears with smaller dimensions.

A manual drive shaft 24, to which a machine head 25 is attached, is provided for the aforementioned manual drive or manual adjustability of the adjustment drive 1. The machine head 25 serves as a grip for turning and adjusting the manual drive shaft 24. A crown wheel 26 is disposed at the end of the manual drive shaft 24 facing away from the machine head.

In the assembled state, the manual drive shaft 24 extends through an opening 27 in the lower part of the housing 2 into the latter, wherein the crown wheel 26 is positioned inside the lower part of the housing 2 and meshes with the gear 17 of the fourth gear stage. In this way, the manual drive shaft 24 engages with the fourth stage of the reduction gear, and by operating the machine head 25 the manual drive shaft 24 can be rotated, thereby rotating the tuning peg 5 for the manual adjustment of the string tension. This is possible because the crown wheel 26 of the manual drive shaft 24 engages at a point in the reduction gear where the clamping and friction forces, respectively, that are present away from the drive in the direction of the tuning peg and towards the drive in the direction of the motor are not so high as to render manual operation impossible. Rather, the forces that are present in the gear system can be easily overcome, and tuning peg can be turned.

When the desired rotary position of the tuning peg is reached and therewith the tuning of the string, the self-locking action of the entire seven-stage gear system ensures that the position is held securely and without a renewed unwinding of the string in the winding section 6.

The reduction of the manual drive shaft 24 (starting from the crown wheel 26, through the fourth gear stage, to the tuning peg 5) is approximately 40:1; starting from the manual drive shaft 24 to the motor shaft, the reduction is approximately 1:190.

The foregoing description once again makes it clear that the solution according to the invention brings with it significant benefits. On the one hand, it allows the adjustment drive according to the invention, which can be adjusted manually or with a motorized drive, to have an extremely compact design and, at the same time, the reliable self-locking action of the gear that allows for the position of the tuning peg, after the adjustment of the rotational angle position, to be precisely secured and for an easy simple manual adjustment by skillfully envisioning the place of e engagement of crown wheel at the end of the manual drive shaft.

LIST OF REFERENCE SYMBOLS

1 adjustment drive
2 lower part of the housing
3 housing cover
4 guide sleeve
5 tuning peg
6 winding section
7 clamping pin
8 clamping screw
9 drive motor
10 gear
11 gear
12 gear
13 gear
14 gear
15 gear
16 gear
17 gear
18 gear
19 gear
20 gear
21 gear
22 gear
23 gear
24 manual drive shaft
25 machine head
26 crown wheel
27 opening

The invention claimed is:

1. A combined manual and motorized adjustment drive for adjusting the string tension of a stringed instrument comprising:

a tuning peg for winding and unwinding a string running thereon;

a drive motor;

a force-transmitting member for transmitting a drive force generated by the drive motor to the tuning peg for rotating the latter; and a manually operable adjustment element which couples with the force-transmitting member for manual adjustability of the rotary position of the tuning peg wherein the force-transmitting member is an at least three-stage reduction gear having a first gear stage on which the drive motor acts with an output shaft and a last gear stage which acts on the tuning peg in order to rotate the latter, and the adjustment element acts on a gear stage of the reduction gears between the first and the last gear stages to introduce the force.

2. The adjustment drive according to claim 1, wherein the reduction gear has at least four stages.

3. The adjustment drive according to claim 1, wherein the reduction gear is a spur gear unit.

4. The adjustment drive according to claim 1, wherein the overall reduction of the reduction gear and the reduction ratios of the individual gear stages are selected and adjusted to the drive motor in such a way that a self-locking action is created by the overall reduction of the reduction gear while the adjustment element is moved by hand to manually turn the tuning peg.

5. The adjustment drive according to claim 4, wherein the overall reduction of the reduction gear is between 3000:1 and 4000:1.

6. The adjustment drive according to claim 4 wherein the reduction of the gear stage(s) that fall(s) between the introduction of force by the adjustment element and the tuning peg is in the range between 30:1 and 50:1.

7. The adjustment drive according to claim 1, wherein the reduction gear has seven stages and the introduction of force by the adjustment element occurs at the fourth gear stage.

8. The adjustment drive according to claim 1, wherein the drive motor is a step motor.

9. A device for the automatic tuning of a string of a stringed instrument with a means of detection for determining the current tuning of the string, a computing and comparison unit for comparing the current tuning with a set tuning and for generating adjustment signals, comprising an adjustment drive according to claim 1 which can change the string tension via the drive motor depending on the adjustment signals.

10. A stringed instrument with an adjustment drive according to claim 1.

11. The adjustment drive according to claim 1, wherein the stringed instrument is a guitar.

12. The adjustment drive according to claim 1, wherein the drive motor is an electric motor.

13. The adjustment drive according to claim 2, wherein the reduction gear has seven stages.

14. The adjustment drive according to claim 5, wherein the overall reduction of the reduction gear is between 3500:1 and 4000:1.

15. The adjustment drive according to claim 14, wherein the overall reduction of the reduction gear is between 3770:1 and 3780:1.

16. The adjustment drive according to claim 6 wherein the reduction of the gear stage(s) that fall(s) between the introduction of force by the adjustment element and the tuning peg is in the range between 35:1 and 45:1.

17. A stringed instrument with a device for automatic tuning according to claim 9.

* * * * *